US006419558B2

(12) United States Patent
Watanabe et al.

(10) Patent No.: US 6,419,558 B2
(45) Date of Patent: Jul. 16, 2002

(54) APPARATUS, BACKING PLATE, BACKING FILM AND METHOD FOR CHEMICAL MECHANICAL POLISHING

(75) Inventors: Tomoharu Watanabe; Nobuhiro Kato, both of Mie-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/886,157

(22) Filed: Jun. 22, 2001

Related U.S. Application Data

(62) Division of application No. 09/392,749, filed on Sep. 9, 1999, now Pat. No. 6,276,999.

(30) Foreign Application Priority Data

Oct. 7, 1998 (JP) ..... 10-285606

(51) Int. Cl.[7] ..... B24B 1/00

(52) U.S. Cl. ..... 451/41; 451/286; 451/287; 451/288; 451/289

(58) Field of Search ..... 451/41, 286, 287, 451/288, 289

(56) References Cited

U.S. PATENT DOCUMENTS

| | | | | |
|---|---|---|---|---|
| 5,645,474 A | | 7/1997 | Kubo et al. | |
| 5,791,973 A | * | 8/1998 | Nishio | 451/41 |
| 5,938,512 A | * | 8/1999 | Takei et al. | 451/388 |
| 6,059,921 A | | 5/2000 | Kato et al. | |
| 6,116,992 A | | 9/2000 | Prince | 451/286 |
| 6,139,409 A | | 10/2000 | Inaba | |

* cited by examiner

*Primary Examiner*—Joseph J. Hail, III
*Assistant Examiner*—Shantese McDonald
(74) *Attorney, Agent, or Firm*—Finnegan, Henderson, Farabow, Garrett & Dunner, L.L.P.

(57) ABSTRACT

A polishing apparatus has a guide (5) to be pressed against a polishing cloth (7) when polishing an object (1). Within the guide, a ring (3) is arranged between a backing plate (4) and a backing film (2). When the guide and polishing cloth are rotated to rub with each other, force of the periphery of the object of pressing the polishing cloth drops. The ring prevents such a force drop, thereby equalizing polishing rates over a surface of the object. Also provided is a polishing method applied to the polishing apparatus.

2 Claims, 17 Drawing Sheets

APPARATUS, BACKING PLATE, BACKING FILM AND METHOD FOR CHEMICAL MECHANICAL POLISHING

This is a divisional of application Ser. No. 09/392,749, filed Sep. 9, 1999, which is incorporated herein by reference U.S. Pat. No. 6,276,999.

BACKGROUND OF THE INVENTION

1. Field of the Invention

The present invention relates to a polishing apparatus and a polishing method, and particularly, to the apparatus and the method for polishing semiconductor wafers based on a chemical mechanical polishing (CMP) technique. The present invention also relates to a backing plate and a backing film used by the polishing apparatus.

2. Description of the Related Art

FIG. 1A is a top view showing a polishing apparatus according to a related art and FIG. 1B is a side view showing the same. The polishing apparatus is used for semiconductor device manufacturing for polishing and planarizing the steps in the surface of a semiconductor wafer due to devices and interconnections formed thereon. A disk-like surface plate 8 has a shaft 10 rotated by a driver (not shown). A polishing cloth 7 made of for example, polyurethane foam is attached to the top of the surface plate 8. A port 11 supplies abrasive 12 onto the polishing cloth 7. A wafer base 13 is arranged above the surface plate 8. The bottom of the wafer base 13 holds a wafer. The wafer base 13 has a shaft 9, which is connected to a pressing unit (not shown) and a rotating unit (not shown). The pressing unit presses the wafer against the polishing cloth 7. The rotating unit rotates the wafer in the same direction as the rotating direction of the surface plate 8.

FIG. 2 is a sectional view showing the wafer base 13 and the vicinity thereof. The wafer base 13 is made of a head 6, backing plate 4, a backing film 2, and a guide 5. The head 6 is driven by the shaft 9 and rotates above the surface plate 8. The head 6 is pushed down by the pressing unit through the shaft 9. The head 6 uniformly presses the wafer 1 against the polishing cloth 7 through the backing plate 4. To flatly polish the wafer 1, an interface of the backing plate 4 with the backing film 2 is processed flat. The back film 2 is resilient so that the backing plate 4 may evenly press the wafer 1 against the polishing cloth 7. Even if dust is present between the wafer 1 and the backing film 2, the backing film 2 is flexible to contain the dust so that a surface of the wafer 1 to be polished may evenly be pushed against the polishing cloth 7. The guide 5 prevents the wafer 1 from moving away from the backing film 2. An end face of the guide 5 that faces the polishing cloth 7 is higher than the polished surface of the wafer 1 with respect to the polishing cloth 7. When the wafer 1 is set on the polishing cloth 7, the end face of the guide 5 is away from the polishing cloth 7. When the wafer 1 is pressed against the polishing cloth 7, the backing film 2 and polishing cloth 7 are compressed and the end face of the guide 5 comes in contact with and presses the polishing cloth 7.

With this arrangement the port 11 feeds the abrasive 12 onto the polishing cloth 7 that is rotated The wafer 1 set under the backing film 2 is rotated and pushed by the wafer base 13 toward the polishing cloth 7 so that the surface of the wafer 1 contacting with the polishing cloth 7 is polished.

Polishing rates and their uniformity on a thermal oxidation film formed on the surface of an 8-inch silicon wafer will be explained. The wafer has LSIs formed on the surface thereof The size of each LSI is dependent on a step-and-repeat technique used to form the LSIs and is usually 1-cm square. To improve the yield and quality of LSIs on each wafer, polishing rates within the wafer must be as uniform as possible.

FIG. 3 shows polishing rates measured at different measurement points on a wafer. The wafer is a silicon wafer of 200 mm in diameter and has a thermal oxidation film to be polished with the wafer being pressed against the polishing cloth 7 and the guide 5 being away from the polishing cloth 7. The measurement points 1 to 7 are set along a straight line passing through the notch and center of the. wafer and are away from the center of the wafer by 96 mm, 80 mm, 40 mm, 0 mm, 40 mm, 80 mm, and 96 mm, respectively. Namely, the measurement points 1 and 7 are at the periphery of the wafer, and the measurement point 4 is at the center thereof. Polishing rates measured at the points 1 and 7 are each about 1.7 times greater than that measured at the point 4.

FIG. 4 shows polishing rates measured at different measurement points with the guide 5 being pressed against the polishing cloth 7 when polishing a thermal oxidation film formed on a silicon: wafer of 200 mm in diameter. The measurement points 1 to 7 are the same as those of FIG. 3. Polishing rates at the peripheral measurement points 1 and 7 are about 20% smaller than those at the other measurement points. Compared wit FIG. 3, FIG. 4 shows an improvement in the uniformity of polishing rates on the wafer, and therefore, it can be said that pressing the guide 5 against the polishing cloth 7 is advantageous. This, however, may deteriorate the quality of LSIs formed at the periphery of the wafer below criteria because the peripheral polishing rates are about 20% smaller than the others.

SUMMARY OF THE INVENTION

The reason why the peripheral polishing rates are lower than the others will be examined.

FIG. 5 is a partly see-trough top view showing essential parts of a polishing apparatus. A polishing cloth 7 is circular, 600 mm in diameter, and about 4 mm in thickness. When polishing a wafer 1, the polishing cloth 7 is rotated counterclockwise at about 30 rpm. A guide 5 is a cylinder having an inner diameter of about 202 mm. When polishing the wafer 1, the guide 5 is rotated counterclockwise at about 30 rpm. The wafer 1 is circular, 200 mm in diameter, and about 0.8 mm in thickness. When being polished, the wafer 1 is pushed against a backing film 2 (not shown) that revolves with the guide 5. At this time, the wafer 1 slightly slides on the backing film 2 and rotates counterclockwise at a speed slower than 30 rpm. Under this situation, the wafer 1 is shifted toward a right part of the ring 5, and a gap 16 of about 2 mm is formed between the guide 5 and the left edge of the wafer 1. In connection with this, two cases will be examined.

(1) A first case is that the guide 5 is away from the polishing cloth 7 even after the wafer 1 is pressed against the polishing cloth 7. FIGS. 6A, 6B, and 6C are sectional views taken along a line I—I of FIG. 5. In FIG. 6A, the wafer 1 is not pressed against the polishing cloth 7, and the polishing cloth 7 and a wafer base 13 are not rotated yet. A gap 15 between the guide 5 and the polishing cloth 7 is set to be in the range of 0.3 mm to 0.5 mm so that the guide 5 is away from the polishing cloth 7 after the wafer 1 is pressed against the polishing cloth 7 and so that the wafer 1 may not escape from the guide 5 even when the polishing cloth 7 and wafer base 13 are rotated.

In FIG. 6B, a shaft 9 is thrust to press the wafer 1 against the polishing cloth 7. The wafer 1 compresses the polishing cloth 7, and the backing film 2 on the wafer 1 is also compressed evenly.

In FIG. 6C, the polishing cloth 7 and wafer base 13 are rotated from the condition of FIG. 6B. The polishing cloth 7 moves right ward in FIG. 6C, and therefore, the wafer 1 is shifted toward the right part of the guide 5 and the polishing cloth 7 at the edge of the wafer 1 is deformed due to rotation. In particular, the polishing cloth 7 at the left edge of the wafer 1 rises and is compressed further than FIG. 6B. At this time, the left edge of the wafer 1 is pushed more strongly than the remaining part thereof by the polishing cloth 7, to increase a polishing rate at the left edge.

The reason why polishing rates at the periphery of a wafer is about 1.7 times greater than those at the other parts in FIG. 3 is because the periphery of the wafer is pushed more strongly than the other parts by the polishing cloth 7 and because the wafer 1 is rotated by the wafer base 13.

(2) A second case is that the guide 5 is pressed against the polishing cloth 7 when the wafer 1 is pushed to the polishing cloth 7. FIGS. 7A, 7B, and 7C are sectional views taken along the line I—I of FIG. 5. In FIG. 7A, the wafer 1 is not pressed against the polishing cloth 7, and the polishing cloth 7 and wafer base 13 are not rotated yet. A gap 15 between the guide 5 and the polishing cloth 7 is set to be in the range of 0.21 mm to 0.28 mm so that the guide 5 may be pressed against the polishing cloth 7 when the wafer 1 is pressed against the polishing cloth 7 and so that the wafer 1 may not escape from the guide 5 when the polishing cloth 7 and wafer base 13 are rotated.

In FIG. 7B, the shaft 9 is insist to press the wafer 1 against the polishing cloth 7. The polishing cloth 7 is compressed by the wafer 1, and the backing film 2 on the wafer 1 is also compressed. The guide 5 is pressed against the polishing cloth 7. If the thrust on the shaft 9 is the same as that of FIG. 6B, force of the wafer 1 of pushing the polishing cloth 7 becomes smaller than that of FIG. 6B when the guide 5 is pressed against the polishing cloth 7. The uniformity of the force of the wafer 1 of pushing the polishing cloth 7 of FIG. 7B is substantially the same as that of FIG. 6B because the gap 15 between the guide 5 and the polishing cloth 7 of FIG. 7A is so set. If the gap 15 is narrower, the force of the guide 5 of pressing the polishing cloth 7 will be stronger so that a deformation of the polishing cloth 7 may reach the wafer 1 to deteriorate the uniformity of the force of the wafer 1 of pressing the polishing cloth 7.

In FIG. 7C, the polishing cloth 7 and wafer base 13 are rotated from the state of FIG. 7B. The polishing cloth 7 moves rightward, and therefore, the wafer 1 is shifted toward the right part of the guide 5. At this time, the polishing cloth 7 at the edge of the wafer 1 is deformed by rotation. The polishing cloth 7 at the left edge of a left part of the guide 5 rises and is compressed further than FIG. 7B. On the other hand, the polishing cloth 7 at the right edge of the left part of the guide 5 is stretched. The stretched area of the polishing cloth 7 reaches the wafer 1. Force of the polishing cloth 7 of pushing the wafer 1 in the stretched area is weaker than that in the remaining area, and polishing rates in the stretched area are smaller than the others.

The reason why polishing rates at the periphery of a wafer are about 20% smaller than the others in FIG. 4 is because the force of the polishing cloth 7 of pushing the wafer is small at the periphery of the wafer and because the wafer is rotated by the wafer base 13.

The two cases mentioned above show that force applied to the surface of a wafer is uniform when the wafer is simply pressed against the polishing cloth 7 and becomes uneven when the wafer is rubbed with the polishing cloth 7.

An object of the present invention is to equally distribute force, which is not present when the wafer 1 is pressed against the polishing cloth 7 and is produced when the pressed wafer 1 is rubbed with the polishing cloth 7, over the surface of the wafer 1.

Another object of the present invention is to equalize force on the surface of the wafer 1, thereby equalizing polishing rates on the wafer 1.

Still another object of the present invention is to uniformly polish LSIs formed on a wafer, equalize the quality of the LSIs, and improve the yield of the LSIs.

To accomplish the objects, three ideas are studied:

(1) A first idea is to use harder material for the polishing cloth 7 so that the polishing cloth 7 may not be deformed due to pressing force and friction. If the polishing cloth 7 is hard, it may unevenly contact and polish a wafer. Accordingly, the first idea is inadequate. The polishing cloth 7 must be soft to some extent.

(2) A second idea is that there will be an optimum value for the gap 15 between the guide 5 and the polishing cloth 7 in FIGS. 6A and 7A and that the optimum value will be between the gap 15 of FIG. 6A and that of FIG. 7A. If there is such an optimum gap, force with which the guide 5 pushes the polishing cloth 7 will be smaller than that of FIG. 7C. This force will vary, and therefore, a strongly compressed area of the polishing cloth 7 will move between under the wafer 1 and under the guide 5. This fluctuates polishing rates at the periphery of the wafer 1. Accordingly, the second idea is inadequate.

(3) A third idea is to enlarge the wafer base 13 with respect to the size of the wafer 1 so that the stretched area of the polishing cloth 7 of FIG. 7C may not reach the wafer 1. This, however, produces a highly compressed area not only under the guide 5 but also under the wafer 1. There will be an idea to adjust the edge of the stretched area of the polishing cloth 7 to the edge of the wafer 1. Adjusting the whole edge of the wafer 1 to the edge of the stretched area of the polishing cloth 7 is very difficult. In addition, a play between the guide 5 and the wafer 1 will increase. Accordingly, the third idea is inadequate.

In order to accomplish the objects, the present invention is, first, characterized by that a polishing apparatus for polishing an object, comprises a polishing cloth having a flat bottom face that is moved in a plane containing the bottom face and a top face that is in parallel with the bottom face, a part of the top face being pressed against ba face of the object to be polished and, a guide for surrounding the periphery of the object, the guide being pressed against the top face of the polishing cloth and, a backing structure for pressing an area of the object that is within a predetermined distance from the guide stronger than the remaining area of the object against the polishing cloth. Here, the backing structure consists of a backing plate and a backing film.

A pressing unit thrusts the backing structure to press the object against the polishing cloth. A distribution of force with which the object pushes the polishing cloth is dependent on a distribution of the distance from the guide. The polishing rate is dependent on the force with which the object pushes the polishing cloth. Namely, when the polishing rate is dependent on the distribution of the distance from the guide, changing the distribution of the force equalizes polishing rates on the object. Generally, the guide is pressed against the polishing cloth and the guide and polishing cloth are rotated, force at the periphery of the object of pressing the polishing cloth drops. This force drop is supplemented by the backing structure of the present invention to equalize force of the object on the polishing cloth.

Moreover, preferably, the predetermined distance according to the first feature of the present invention is in the range of 5 mm to 30 mm. The polishing rates on the object become uniform.

Moreover, preferably, the backing structure according to the first feature of the present invention comprises a backing plate that is a flat disk having top and bottom faces that are in parallel with each other and, a cylindrical ring having top and bottom faces that are in parallel with each other and are defined by concentric outer and inner circles, the diameter of the outer circle being equal to the diameter of the backing plate, the center of the top face of the ring agreeing with the center of the bottom face of the backing plate and, a backing film whose hardness is lower than that of the backing plate, having a flat disk shape having the same diameter as the backing plate and top and bottom faces that are in parallel with each other, the center of the top face of the backing film agreeing with the center of the bottom face of the ring.

Since the backing structure has a changing thickness depending on distances from the guide, a distribution of force with which the object pushes the polishing cloth is dependent on a distribution of the thickness of the backing structure. Namely, the distribution of the thickness of the backing structure determines a distribution of polishing rates on the object. Generally, polishing rates on the object are dependent on distances from the guide, and therefore, the changing thickness of the backing structure that are dependent on distances from the guide equalizes polishing rates on the object. The ring provides the same effect as the thickness change of the backing structure. The thickness and width of the ring are determined based on the type of an object to polish. Objects to be polished by the apparatus of the present invention need different abrasives and polishing rates and have different coefficients of friction with respect to the polishing cloth. Therefore, force on the polishing cloth and torque to rotate the polishing cloth depend on an object to polish. Namely, a force drop at the periphery of an object and an area where the force drop occurs are dependent on the object. This is the reason why the thickness and width of the ring must be determined based on the properties of an object to polish.

The present invention is capable of equalizing force, which is not present when a wafer is set on the polishing cloth and is produced when the wafer is rubbed with the polishing cloth, on the surface of the wafer, thereby equalizing polishing rates over the wafer. The present invention is capable of uniformly polishing LSIs formed on a wafer, thereby equaling the quality of the LSIs and improving the yield thereof. The present invention is capable of improving the polishing speed of each wafer, thereby shortening a polishing time of wafers, improving the productivity of LSIs cut from the wafers, and reducing the production cost of the LSIs.

Moreover, preferably, the height of the ring according to the first feature of the present invention is in the range of 30 $\mu$m to 60 $\mu$m. And the difference between the diameters of the outer and inner circles of the ring is within the range of 10 mm to 60 mm. The polishing rates on the object become uniform.

Moreover, preferably, the backing structure according to the first feature of the present invention comprises a backing plate composed of a disk and a cylindrical ring, the disk having top and bottom faces that are in parallel with each other, the ring having top and bottom faces that are in parallel with each other and are defined by concentric outer and inner circles, the diameter of the outer circle being equal to the diameter of the disk, the center of the top face of the ring agreeing with the center of the bottom face of the disk, and a backing film whose hardness is lower than that of the backing plate, having a flat disk shape having the same diameter as the outer circle of the ring and top and bottom faces that are in parallel with each other, the center of the top face of the backing film agreeing with the center of the bottom face of the ring. Namely, partly changing the thickness of the backing plate provides the effect of partly changing the thickness of the backing structure.

Moreover, preferably, the backing structure according to the first feature of the present invention comprises a backing plate that is a disk having top and bottom faces that are in parallel with each other, and a backing film whose hardness is lower than that of the backing plate, composed of a disk film and a ring film, the disk film having top and bottom faces that are in parallel with each other, the ring film having top and bottom faces that are in parallel with each other and are defined by concentric outer and inner circles, the diameter of the outer circle being equal to the diameter of the disk film, the center of the bottom face of the ring film agreeing with the center of the top face of the disk film, the top face of the ring film being in contact with the backing plate. Namely, partly changing the thickness of the backing film provides the effect of partly changing the thickness of the backing structure. Preferably, the hardness of the ring film according to the first feature of the present invention is equal to that of the disk film. The backing film is capable of monolithically forming.

The second feature of the present invention is characterized by that a backing plate comprises a flat disk having top and bottom faces that are in parallel with each other, and a cylindrical ring having top and bottom faces that are in parallel with each other and are defined by concentric outer and inner circles, the diameter of the outer circle being equal to the diameter of the disk, the center of the top face of the ring agreeing with the center of the bottom face of the disk. When the guide is pressed against the polishing cloth and the guide and polishing cloth are rotated, force at the periphery of the object of pressing the polishing cloth drops. This force drop is supplemented by the backing plate of the present invention to equalize force of the object on the polishing cloth.

Moreover, preferably, the height of the ring according to the second feature of the present invention is in the range of 30 $\mu$m to 60 $\mu$m. And the difference between the diameters of the outer and inner circles of the ring is within the range of 10 mm to 60 mm. The polishing rates on the object become uniform.

The third feature of the present invention is characterized by that a backing film comprises a flat disk film having top and bottom faces that are in parallel with each other, and a ring film having top and bottom faces that are in parallel with each other and are defined by concentric outer and inner circles, the diameter of the outer circle being equal to the diameter of the disk film, the center of the bottom face of the ring film agreeing with the center of the top face of the disk film. When the guide is pressed against the polishing cloth and the guide and polishing cloth are rotated, force at the periphery of the object of pressing the polishing cloth drops. This force drop is supplemented by the backing film of the present invention to equalize force of the object on the polishing cloth.

Moreover, preferably, the thickness of the ring film according to the third feature of the present invention is in the range of 30 $\mu$m to 60 $\mu$m. And the difference between the diameters of the outer and inner circles of the ring film is within the range of 10 mm to 60 mm. The polishing rates on the object become uniform.

Moreover, preferably, the hardness of the ring film according to the third feature of the present invention is equal to that of the disk film. The force at the periphery of the object of pressing the polishing cloth easily becomes greater.

The fourth feature of the present invention is characterized by that a method of polishing an object comprises the steps of (a) making the object come in contact with a backing structure and a polishing cloth while a guide being away from the polishing cloth by a gap, and (b) pressing the object with the backing structure and polishing cloth s o that a peripheral area of the object is pressed stronger than the remaining area thereof, and at the same time, pressing the guide against the polishing cloth, and (e) moving the polishing cloth with respect to the object. The guide is properly pressed against the polishing cloth. When the guide and polishing cloth are rotated, a drop of the force at the periphery of the object of pressing the polishing cloth is supplemented by the step of pressing the object of the present invention to equalize force of the object on the polishing cloth.

Moreover, preferably, the gap film according to the fourth feature of the present invention is in the range of 0.07 mm to 0.28 mm, The guide is properly pressed against the polishing cloth.

Moreover, preferably, a boundary between the peripheral area of the object and the remaining area thereof according to the fourth feature of the present invention is away from the guide by a constant distance tat is within the range of 5 mm to 30 mm. When the guide and polishing cloth are rotated, a drop of the force at the only periphery of the object of pressing the polishing cloth is supplemented.

Other and further objects and features of the present invention will become obvious upon an understanding of illustrative embodiments about to be described in connection with the accompanying drawings or will be indicated in the appended claims, and various advantages not referred to herein will occur to one skilled in the art upon employing of the invention in practice.

DETAILED DESCRIPTION OF THE EMBODIMENTS

Figure 1A:
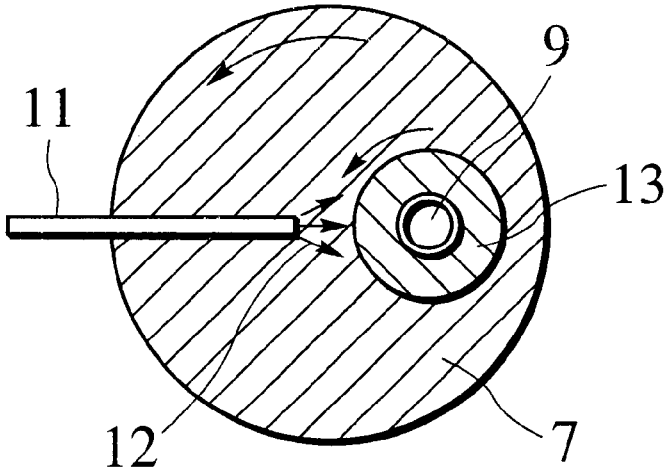
FIGS. 1A and 1B are top and side views showing a polishing apparats according to a related art.
Figure 1B:
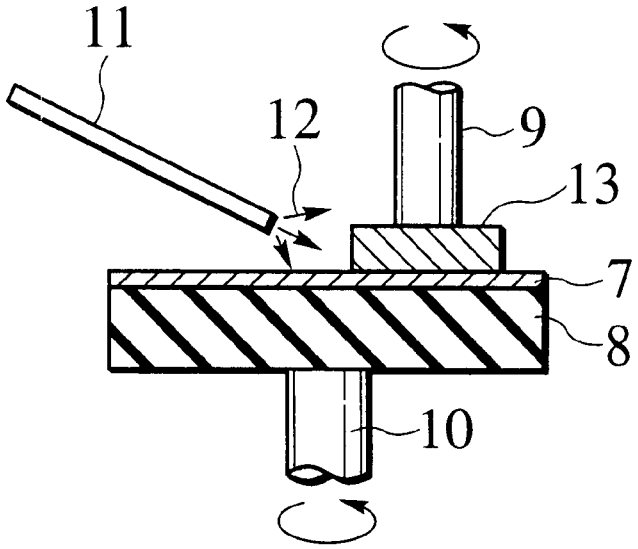
Figure 2:
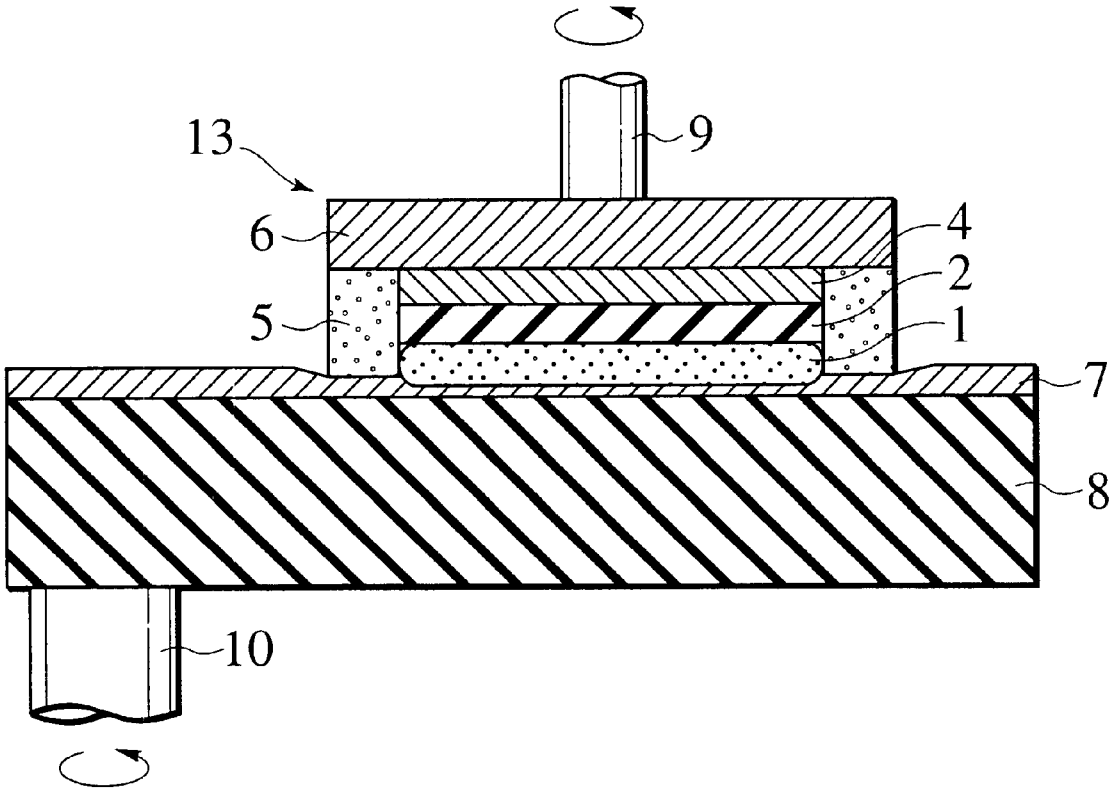
FIG. 2 is a sectional view showing the polishing apparatus of the related art.
Figure 3:
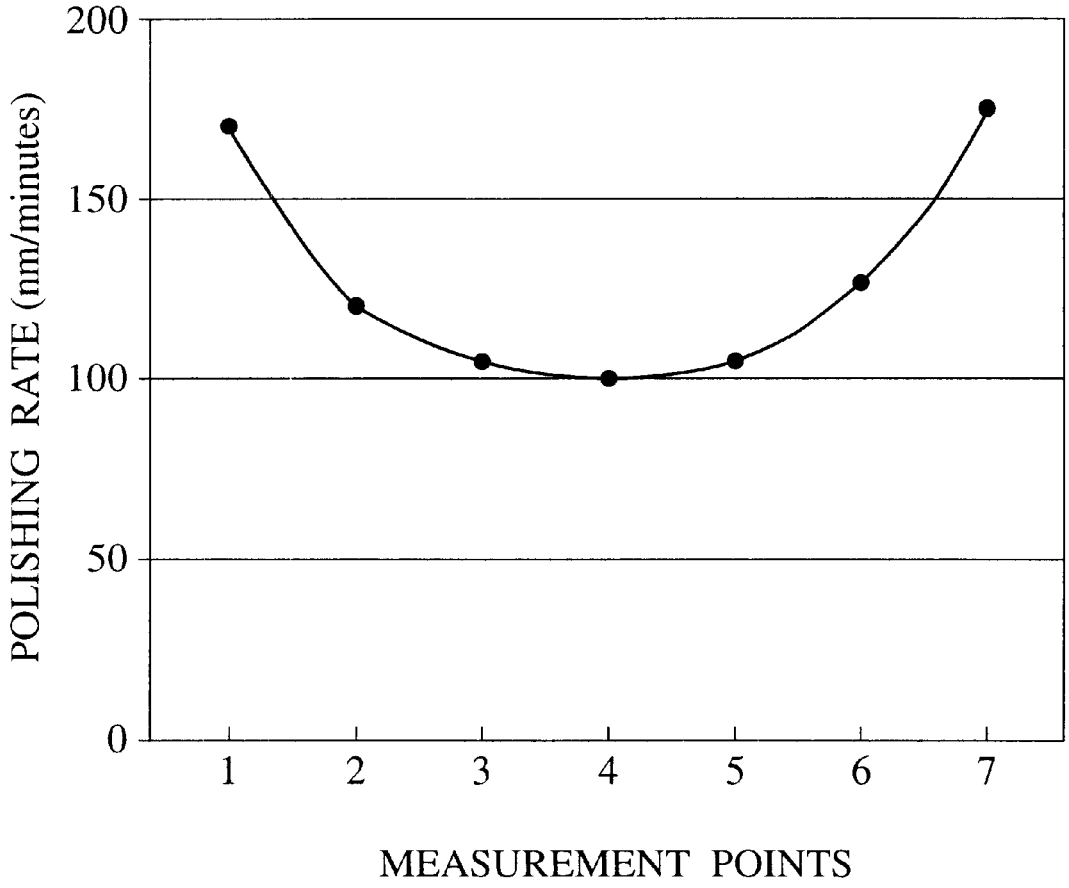
FIGS. 3 and 4 are graphs showing polishing rates measured at different measurement points on a thermal oxidation film of a wafer polished with the polishing apparatus of the related art.

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified, The drawings show only models of the embodiments, and the thicknesses, dimensions, and the proportion of thicknesses of layers of elements shown differ from actual ones. The actual thicknesses and dimensions of the elements must be judged from the following description. The dimensions and proportions of the elements may differ from one drawing to another.

Figure 8A:
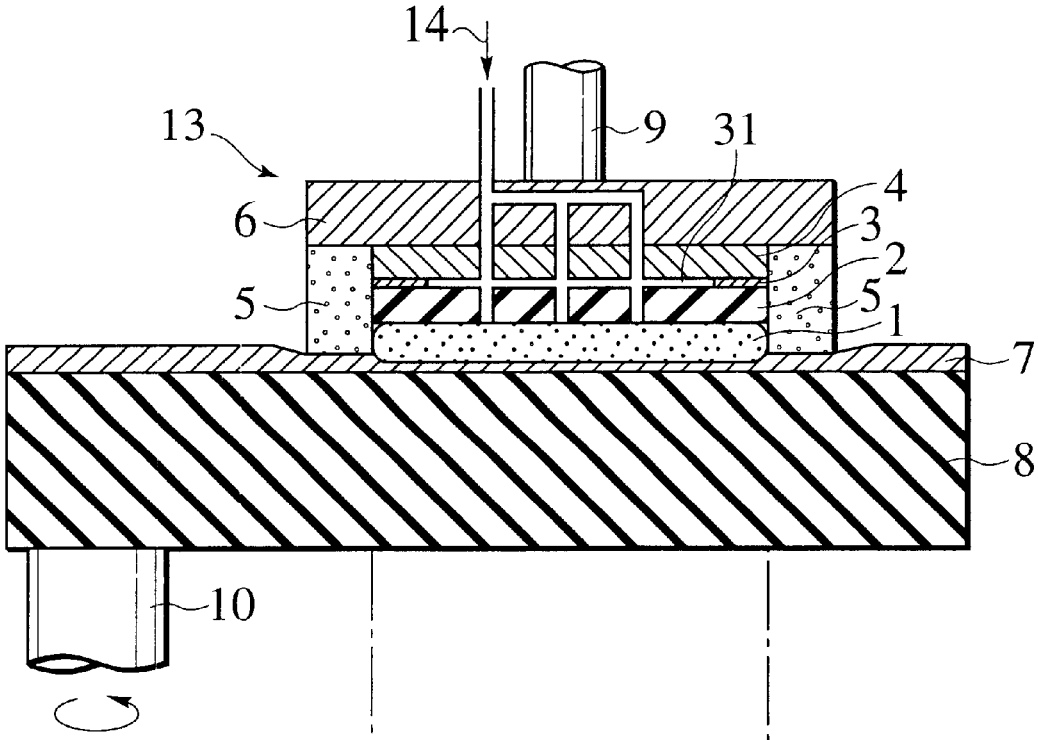
FIG. 8A is a sectional view showing a polishing apparatus according to an embodiment of the present invention.
Figure 8B:
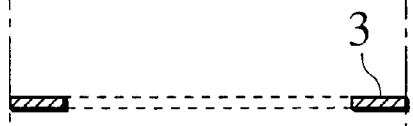
FIGS. 8B and 8C are sectional and top views showing a ring of the polishing apparatus of FIG. 8A.
Figure 8C:
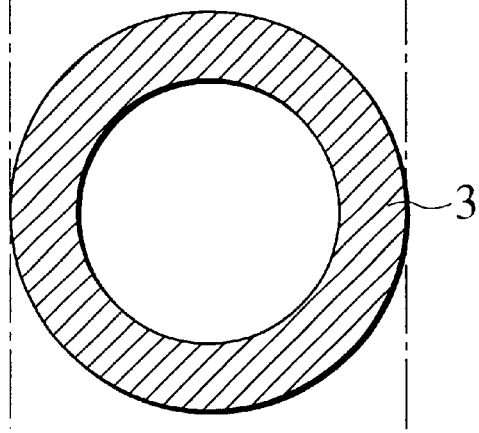

FIG. 8A is a sectional view showing the vicinity of a wafer base 13 of a polishing apparatus according to an embodiment of the present invention. The polishing apparatus has at least a polishing cloth 7, a guide 5 surrounding an object (e.g., a silicon wafer) 1 to polish, and a backing structure to support the wafer 1 between the polishing cloth 7 and the backing structure. The thickness of the backing structure changes depending on distances from the guide 5. The backing structure consists of a backing plate, 4, a backing film 2, and a ring 3. The wafer base 13 consists of a head 6, the backing plate 4, the backing film 2, the guide 5, and the ring 3. The guide 5 is cylindrical. The ring 3 is arranged between the backing plate 4 and the backing film 2. The head 6, backing plate 4, and backing film 2 have holes, which pass compressed air 14 to pressurize the wafer 1. The polishing cloth 7 is attached to a surface plate 8 having a shaft 10. The shaft 10 is connected to a motor (not shown) to rotate the surface plate 8 through the shaft 10. The polishing cloth 7 rotates with the surface plate 8. Abrasive is supplied onto the polishing cloth 7. The wafer 1 is set under the backing film 2. The wafer base 13 is rotated and thrust to press the wafer 1 against the polishing cloth 7. The compressed air 14 pressurizes a central part of the top of the wafer 1 so that a surface of the wafer 1 contacting the polishing cloth 7 is polished. FIGS. 8B and 8C are sectional and top views showing the ring 3. The ring 3 is made of, preferably, polyethylene terephthalate (PET). The ring 3 may be made of other material such as stainless steel, fluorine-contained polymers, polytetrafluoroethylene (PTFE), polyethylene, polypropylene, polystyrene, polyimide, and polyvinyl chloride (PVC). The head 6 may be made of polycarbonate and Vespel of Du Pont. The backing plate 4 may be made of stainless steel and ceramics such as alumina ($Al_2O_3$). The backing film 2 may be made of polyurethane. The polishing cloth 7 may be made of polyurethane and rayon.

To clarify the effect of the ring 3 of the present invention, a mechanism of equalizing polishing rates on a wafer will be examined.

Figure 5:
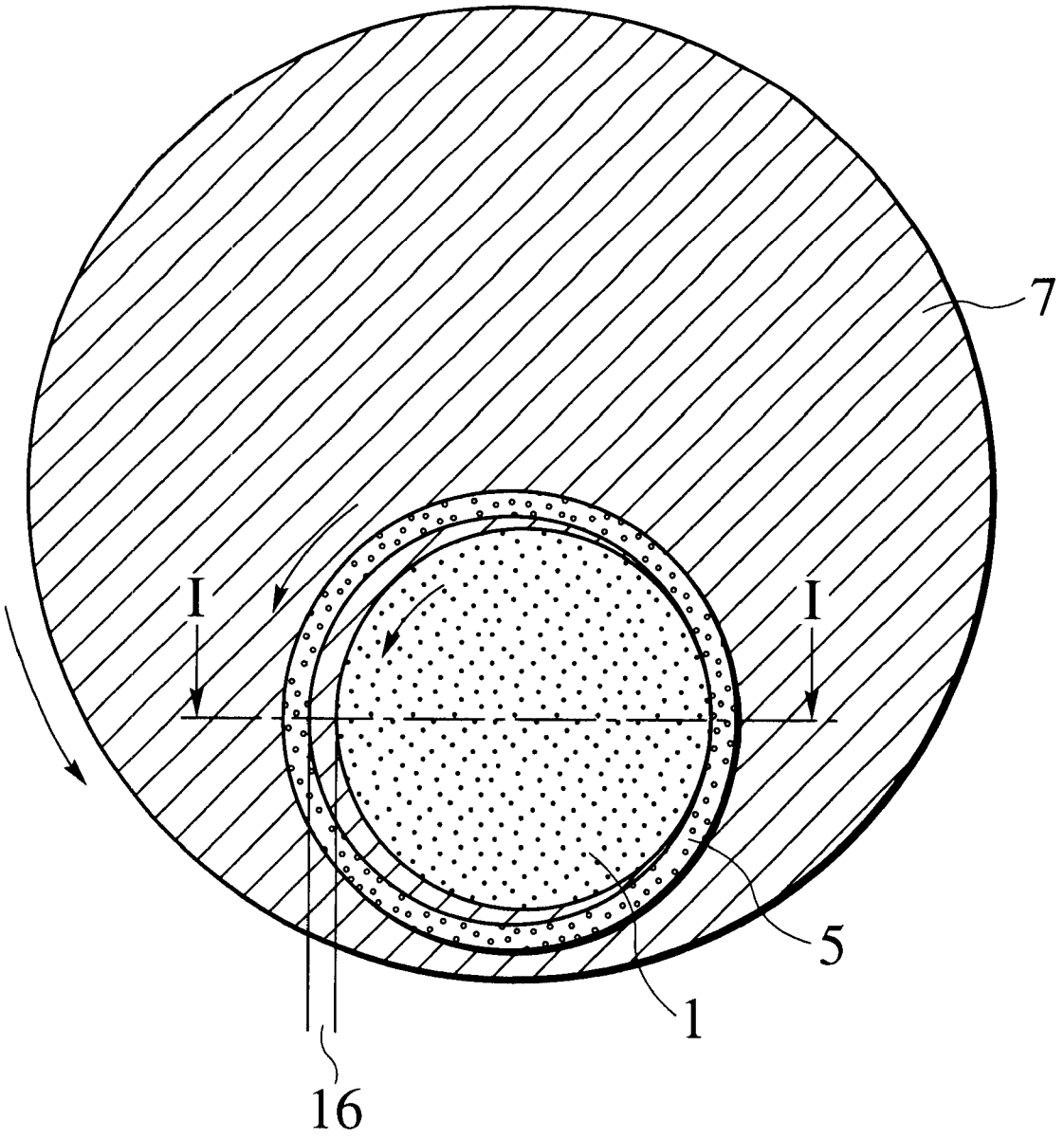
FIG. 5 is a partly see-trough top view showing essential parts of a polishing apparatus.
Figure 6A:
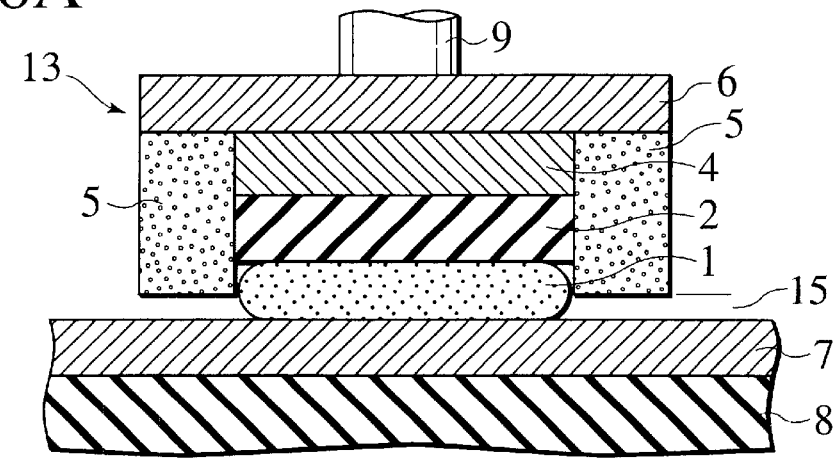
FIGS. 6A and 7A are sectional views showing no-press, no-rotation states of the polishing apparatus of the related art.
Figure 6B:
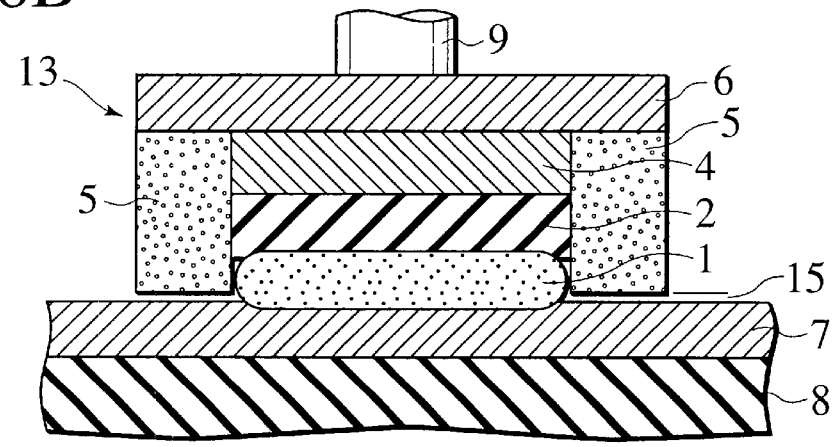
FIGS. 6B and 7B are sectional views showing pressed no-rotation states of the polishing apparatus of the related art.
Figure 6C:
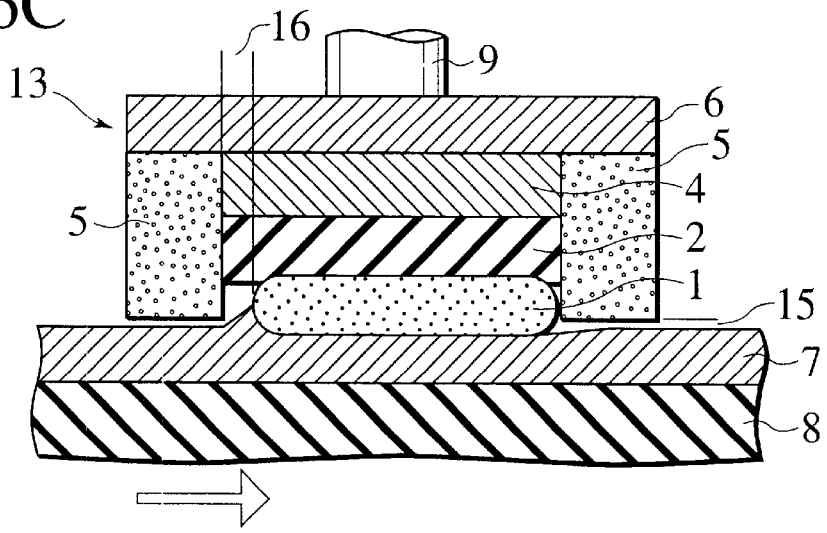
FIGS. 6C and 7C are sectional views showing pressed rotating states of the polishing apparatus of the related ad.
Figure 7A:
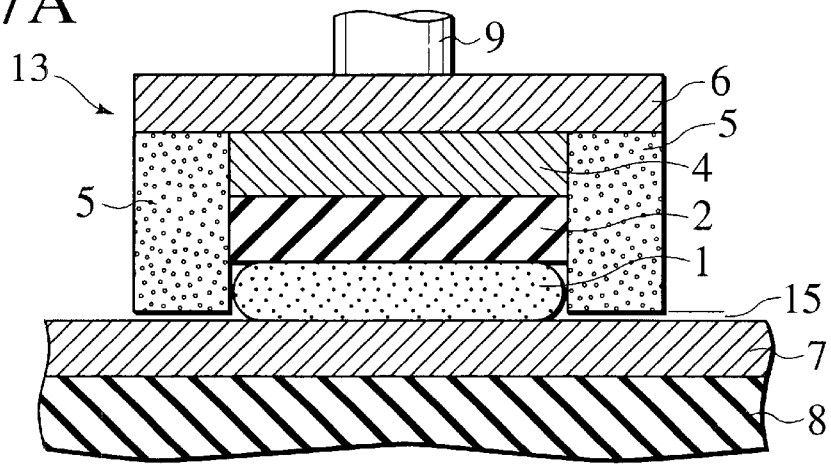
Figure 7B:
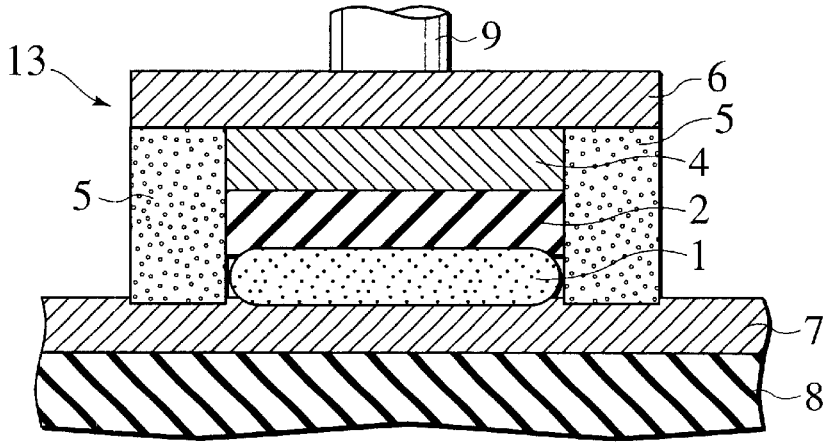
Figure 7C:
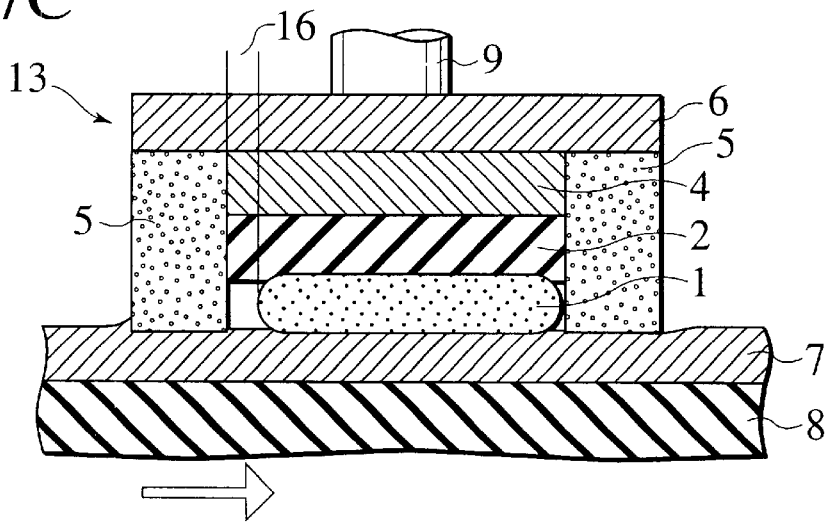
Figure 9A:
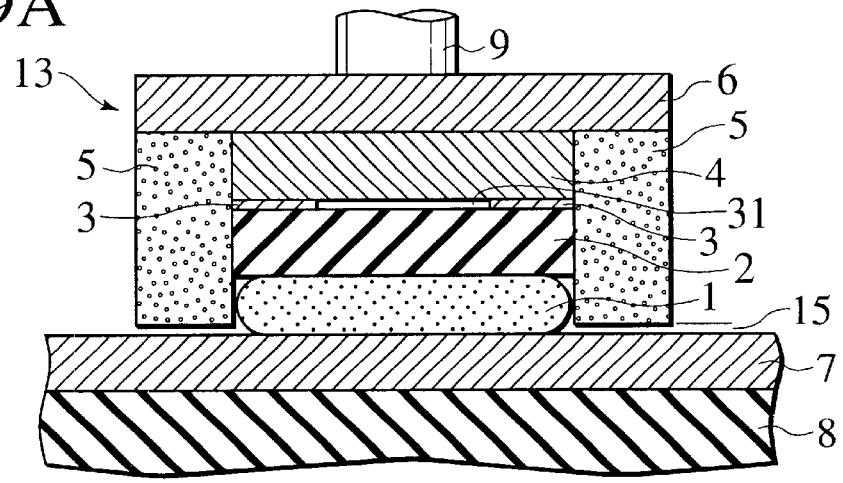
FIG. 9A is a sectional view showing a no-press, no-rotation state of the polishing apparatus of the present invention.
Figure 9B:
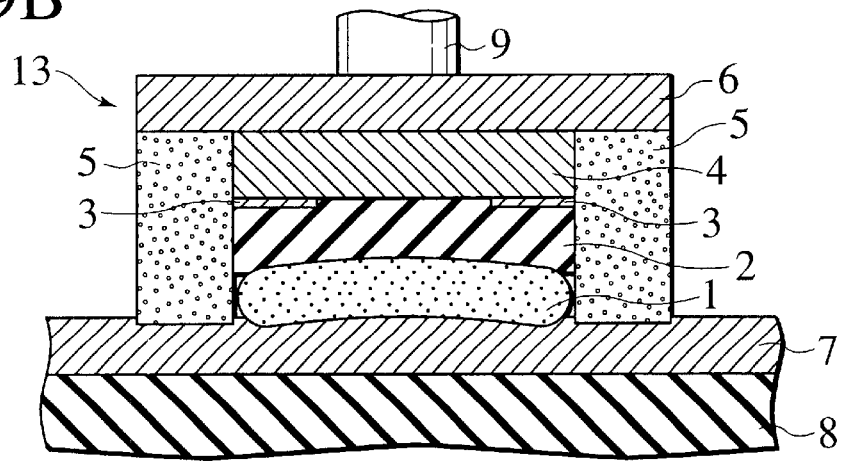
FIG. 9B is a sectional view showing a pressed no-rotation state of the polishing apparatus of the present invention.
Figure 9C:
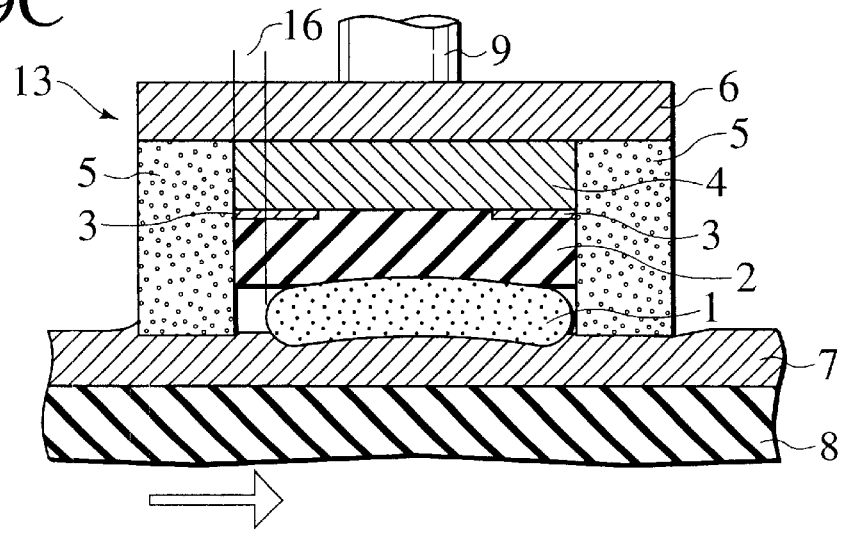
FIG. 9C is a sectional view showing a pressed rotating state of the polishing apparatus of the present invention.

FIGS. 9A, 9B, and 9C are sectional views showing the polishing apparatus of the present invention and corresponding to a sectional view taken along the line I—I of FIG. 5. In FIG. 9A, the wafer 1 is not pressed against the polishing cloth 7, and the polishing cloth and wafer base 13 are not rotated. In this situation, a gap 15 between the guide 5 and the polishing cloth 7 is in the range of 0.07 mm to 0.28 mm. With the gap 15 being within this range, the guide 5 can be pressed against the polishing cloth 7 when the wafer 1 is pressed against the polishing cloth 7. The wafer 1 will not move out of the guide 5 when the polishing cloth 7 and wafer base 13 are rotated. The ring 3 forms a space 31 between the backing plate 4 and the backing film 2.

In FIG. 9B, the shaft 9 is thrust to press the wafer 1 against the polishing cloth 7. The polishing cloth 7 is compressed by the wafer 1, and the backing film 2 on the wafer 1 is also compressed. A part of the backing film 2 that is in contact with the ring 3 is compressed and a part of the backing film 2 that is under the space 31 is not compressed. This phenomenon continues even if large force is applied to close the space 31. As a result, the backing film 2 applies larger force to the wafer 1 under the ring 3 and smaller force thereto under the space 31, thereby curving the wafer 1 into a concave on the polishing cloth 7. Namely, the wafer 1 strongly compresses the polishing cloth 7 under the ring 3 and weakly compresses the same under the space 31. In other words, the wafer 1 receives larger force from the polishing cloth 7 under the ring 3 and smaller force from the same under the space 31. Namely, the surface of the wafer 1 receives uneven force from he polishing cloth 7. Changing he thickness and width of the ring 3 changes the magnitude and distribution of force applied to the wafer 1. The thickness of the ring 3 may, be uniform, or changed in steps, or changed continuously.

In FIG. 9C, the polishing cloth 7 and wafer base 13 are rotated from the state of FIG. 9B. The polishing cloth 7 moves rightward, and therefore, the wafer 1 is shifted toward a right part of the guide 5 as explained with reference to FIG. 5. The polishing cloth 7 at the edge of the wafer 1 deforms due to rotation. The polishing cloth 7 at the left edge of a left part of the guide 5 rises and is compressed greater than FIG. 9B. An area of the polishing cloth 7 from the right edge of the left part of the guide 5 to the wafer 1 is stretched, In the stretched area, force of the polishing cloth 7 of pressing the wafer 1 is weaker than that of the remaining part. As shown in FIG. 9B, force of the polishing cloth 7 of pressing the wafer 1 under the ring 3 is stronger. As a result, force of the polishing cloth 7 of pressing the wafer 1 is equalized over the wafer 1 in FIG. 9C. This, however, is not a complete equalization because force of the polishing cloth 7 of pushing the wafer 1 under the right part of the ring 3 is stronger than that under the space 31. The wafer 1 is rotated, and therefore, the periphery of the wafer 1 alternately passes under the right and left parts of the ring 3. This means that polishing rates on the wafer 1 will be equalized if settings are made to equalize an average of polishing rates under the right and left parts of the ring 3 with a polishing rate under the space 31. In consequence, the ring 3 increases force of pressing the periphery of the wafer 1 against the polishing cloth 7 to dissolve an unevenness of force on the wafer 1 that is not present when the wafer 1 is simply pressed. against the polishing cloth 7 and is created when the pressed wafer 1 and polishing cloth 7 are rotated.

Figure 10A:
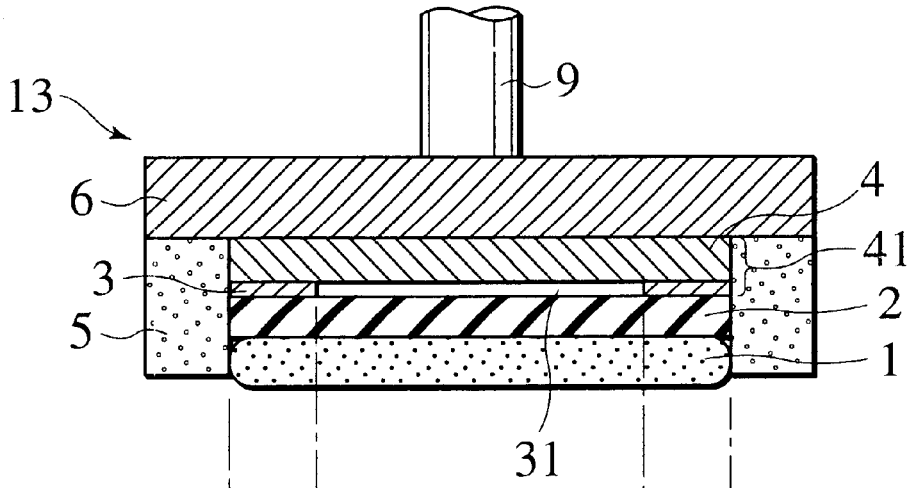
FIG. 10A is a sectional view showing the vicinity of a wafer base of a polishing apparatus according to a first modification of the present invention.
Figure 10B:
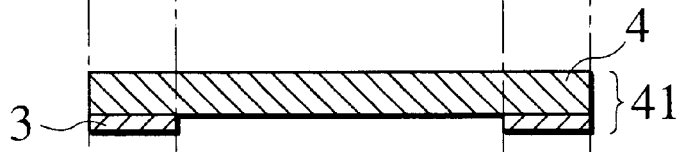
FIGS. 10B and 10C are sectional and bottom views showing a backing plate of the polishing apparatus of FIG. 10A.
Figure 10C:
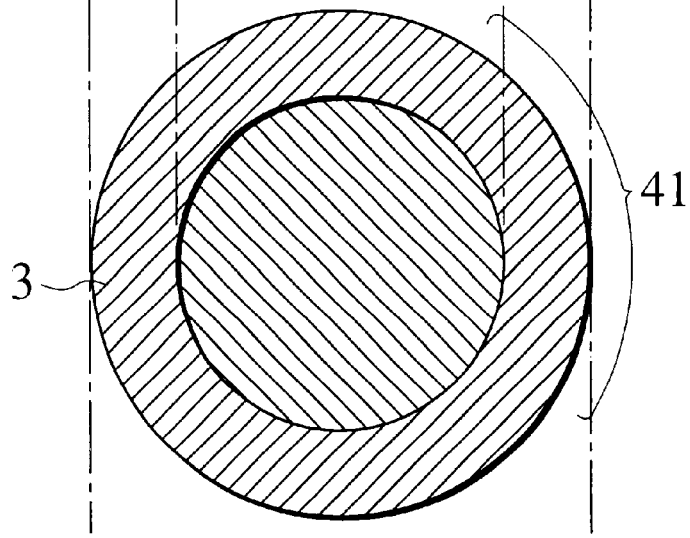

FIGS. 10A, 10B, and 10C show a backing plate 41 according to the first modification of the present invention. The backing plate 41 is a combination of a ring 3 and a backing plate 4 tat are solidified together with, for example, adhesives. The ring 3 and backing plate 4 are made of different materials. In FIG. 10A, the backing plate 41 is installed on a wafer base 13. FIGS. 10B and 10C are sectional and bottom views showing the backing plate 41. The backing plate 41 and a backing film 2 form a backing structure of the present invention.

Figure 11A:
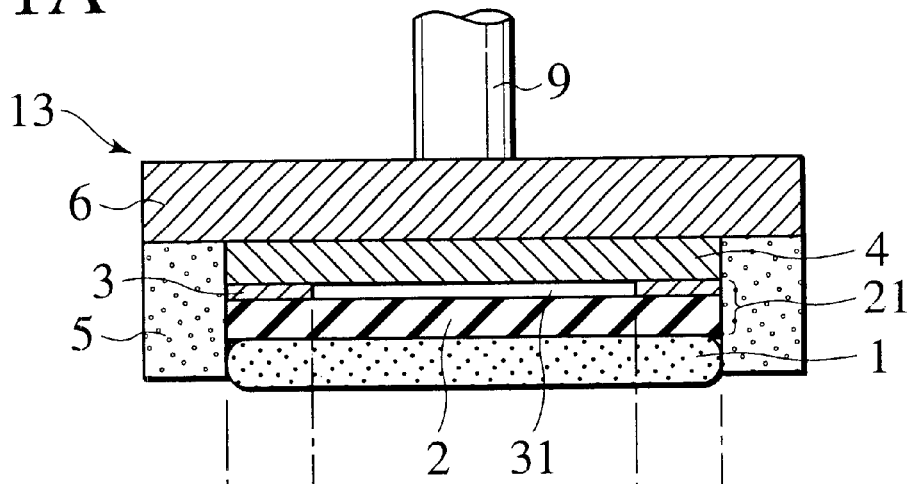
FIG. 11A is a sectional view showing the vicinity of a wafer base of a polishing apparatus according to a second modification of the present invention.
Figure 11B:
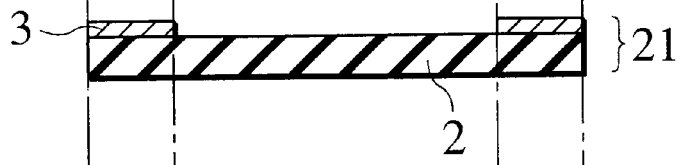
FIGS. 11B and 11C are sectional and top views showing a backing film of the polishing apparatus of FIG. 11A.
Figure 11C:
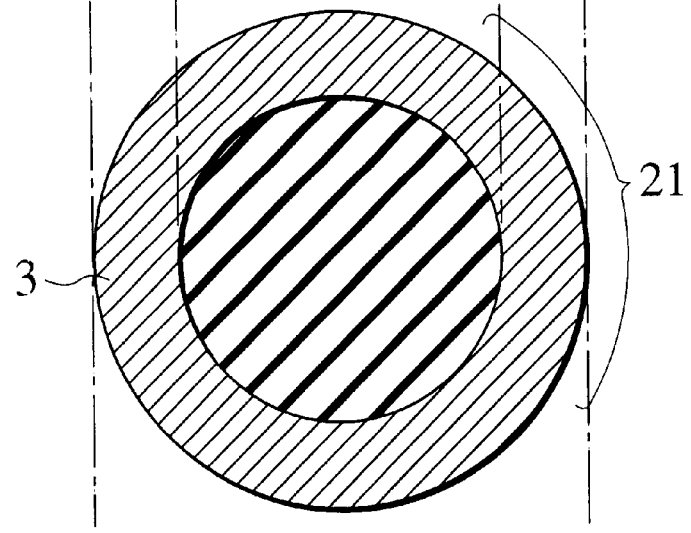

FIGS. 11A, 11B, and 11C show a backing film 21 according to the second modification of the present invention. The backing film 21 is a combination of a backing film 2 and a ring 3 that are solidified together with, for example, adhesives. The backing film 2 and ring 3 are made of different materials. In FIG. 11A, the backing film 21 is installed on a wafer base 13. FIGS. 11B and 11C are sectional and top views showing the backing film 21. The backing film 21 and a backing plate 4 form a backing structure of the present invention.

Figure 12A:
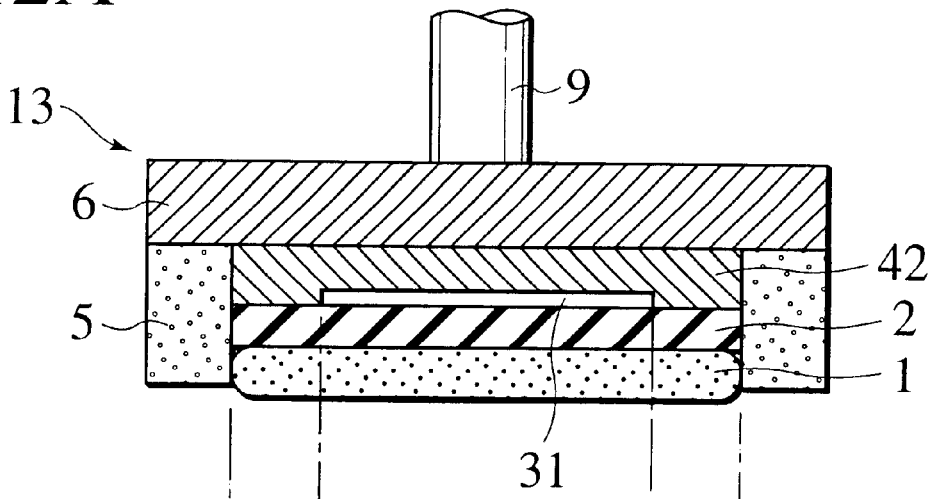
FIG. 12A is a sectional view showing the vicinity of a wafer base of a polishing apparatus according to a third modification of the present invention.
Figure 12B:
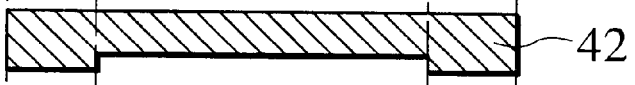
FIGS. 12B and 12C are sectional and bottom views showing a backing plate of the polishing apparatus of FIG. 12A.
Figure 12C:
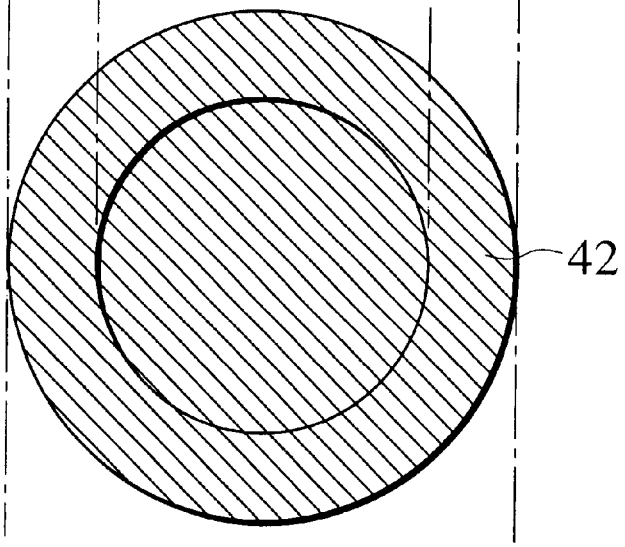

FIGS. 12A, 12B, and 12C show a backing plate 42 according to the third modification of the present invention. The backing plate 42 has a recess to realize the function of the ring 3 of FIG. 8A. In FIG. 12A, the backing plate 42 is installed on a wafer base 13. FIGS. 12B and. 12C are sectional and bottom views showing the backing plate 42. The backing plate 42 and a backing film 2 form a backing structure of the present invention.

Figure 13A:
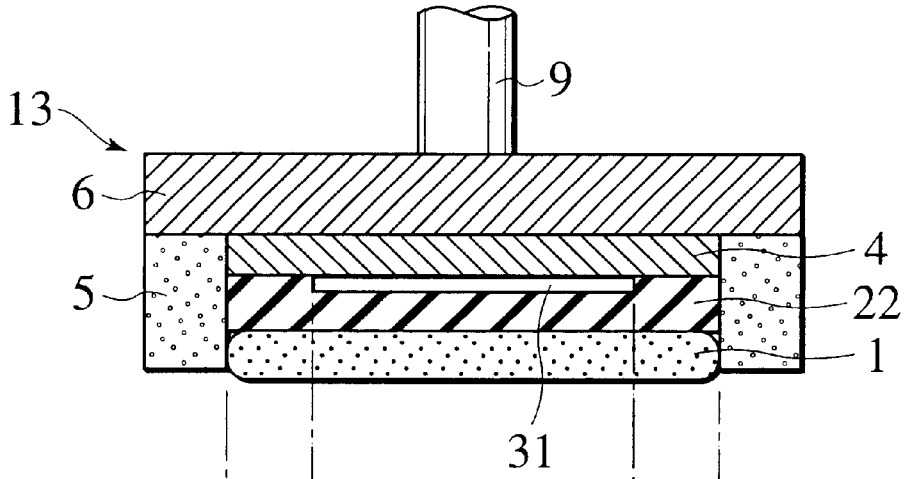
FIG. 13A is a sectional view showing the vicinity of a wafer base of a polishing apparatus according to a fourth modification of the present invention.
Figure 13B:
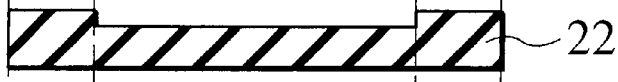
FIGS. 13B and 13C are sectional and top views showing a backing film of the polishing apparatus of FIG. 13A.
Figure 13C:
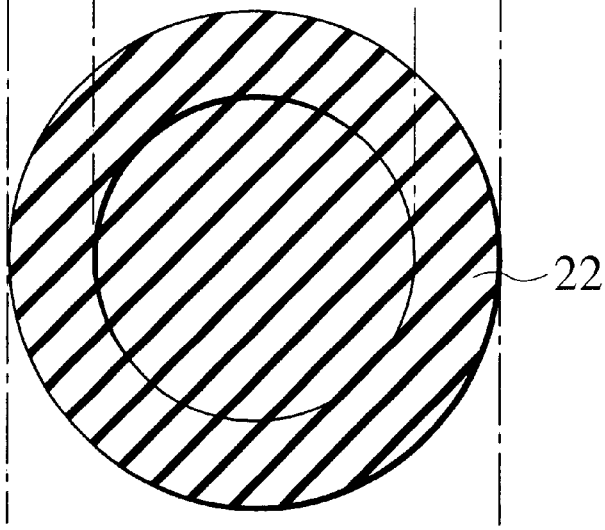

FIGS. 13A, 13B, and 13C show a backing film 22 according to the fourth modification of the present invention. The backing film 22 has a recess to realize the function of the ring 3 of FIG. 8A. In FIG. 13A, the backing film 22 is installed on a wafer base 13. FIGS. 13B and 13C are sectional and top views showing the backing film 22. The backing film 22 and a backing plate 4 form a backing structure of the present invention.

First Embodiment

The first embodiment polishes a thermal oxidation film formed on an 8-inch silicon wafer 1.

The first embodiment employs the: polishing apparatus of FIG. 8A. The backing plate 4 is a disk having a diameter of about 201 mm and a thickness of about 9.1 mm. The backing film 2 is a circular film having a diameter of about 201 mm and a thickness of about 0.5 mm and made of urethane. The guide 5 is a cylinder having an inner diameter of 202 mm, an external diameter of about 220 mm, and a height of about 10 mm. The ring 3 has an inner diameter of 181 mm, an external diameter of 201 mm, a width of 10 mm, and a thickness of 30 $\mu$m. The surface plate 8 has a diameter of 600 mm. The surface plate 8 and the polishing cloth 7 attached thereto are rotated at 50 rpm. The thickness of the polishing cloth 7 is about 4 mm. The abrasive 12 is supplied onto the polishing cloth 7 at 200 cc/min. The wafer 1 is set under the backing film 2 of the wafer base 13. The wafer base 13 is rotated at 50 rpm and is pressed against the polishing cloth 7 under 500 g/cm$^2$. The air 14 is pressurized to 400 g/cm$^2$ to press a central part of the top of the wafer 1. As a result, the thermal oxidation film of the wafer 1 is polished.

Figure 4:
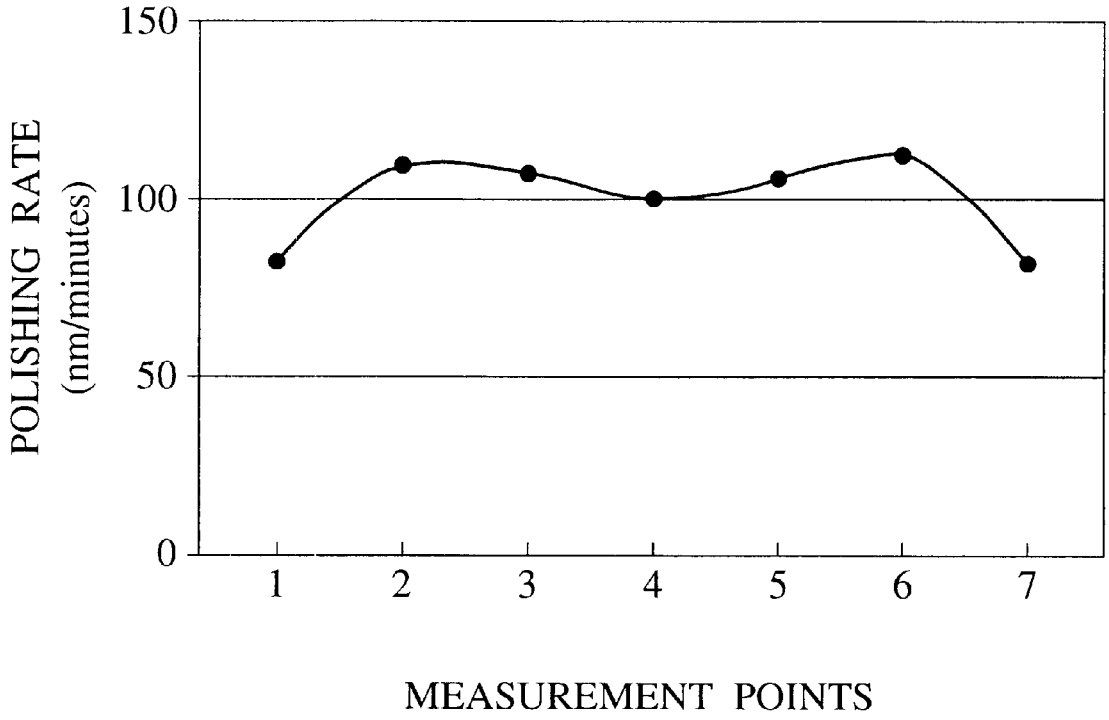
Figure 14:
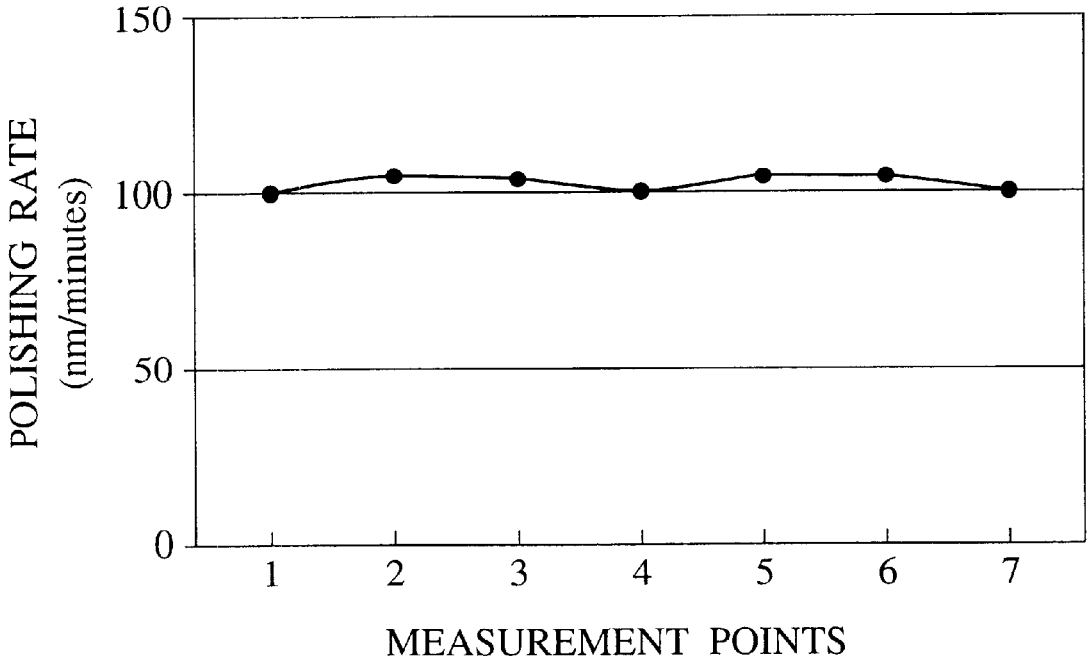
FIG. 14 is a graph showing polishing rates measured at different measurement points on a thermal oxidation film of a wafer polished with the polishing apparatus of the present invention.

FIG. 14 is a graph showing polishing rates at various measurement points on the thermal oxidation film of the silicon wafer 1 of 200 mm in diameter with both the wafer 1 and guide 5 pressed against the polishing cloth 7. The measurement points 1 to 7 are. set along a straight line passing through the notch and center of the wafer 1 and are away from the center of the wafer 1 by 96 mm, 80 mm, 40 mm, 0 mm, 40 mm, 80 mm, and 96 mm, respectively. The graph shows that polishing rates at the periphery of the wafer 1 are substantially the same as those at the remaining part of the wafer 1. Compared with FIG. 4, it is understood that the ring 3 of the present invention improves the uniformity of polishing rates over the wafer 1. Since the polishing rates at the periphery of the wafer 1 are substantially equal to those at the other parts, LSIs formed at the periphery of the wafer 1 keep criteria. When the dimensions of the ring 3 are changed to 151 mm in inner diameter, 201 mm in outer diameter, 25 mm in width, and 30 $\mu$m in thickness with the other conditions unchanged, polishing rates on the wafer 1 are also equalized like FIG. 14.

Figure 15A:
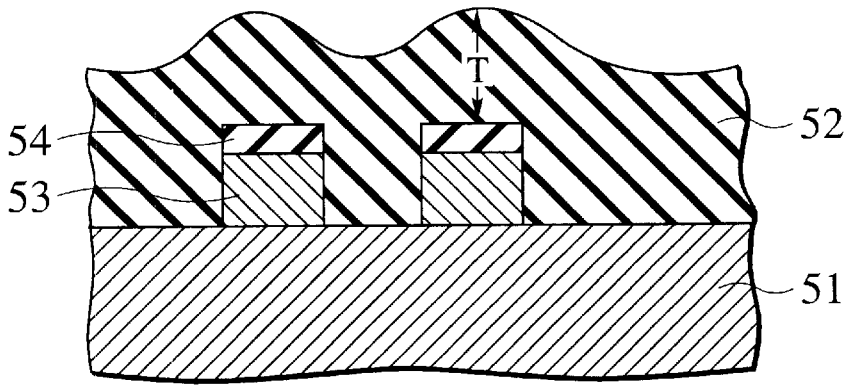
FIG. 15A is a sectional view showing a wafer with patterns covered with a thermal oxidation film on which polishing rites are measured.

FIG. 15A shows a wafer 51 having patterns and covered with a thermal oxidation film to be polished according to the present invention. The wafer 51 is an 8-inch silicon wafer. Each pattern on the wafer 51 is made of a polysilicon layer 53 and a silicon nitride ($Si_3N_4$) layer 54. The thermal oxidation film 52 tat covers these patterns is a silicon oxide ($SiO_2$) film formed by CVD method. The silicon oxide film 52 rises on the patterns. These rises cause breakage in LSI wiring, and therefore, must be removed by polishing. Compared with polishing a wafer having no patterns, polishing a wafer having patterns resembles a polishing work carried out during a multilayer wiring process of LSIs. When the wafer 51 having rises is pressed against the polishing cloth 7, valleys between the rises hardly get in contact with the polishing cloth 7. As a result, the rises of the wafer 51 are strongly pressed against the polishing cloth 7 to increase unevenness in pressing force on the wafer 51.

Figure 15B:
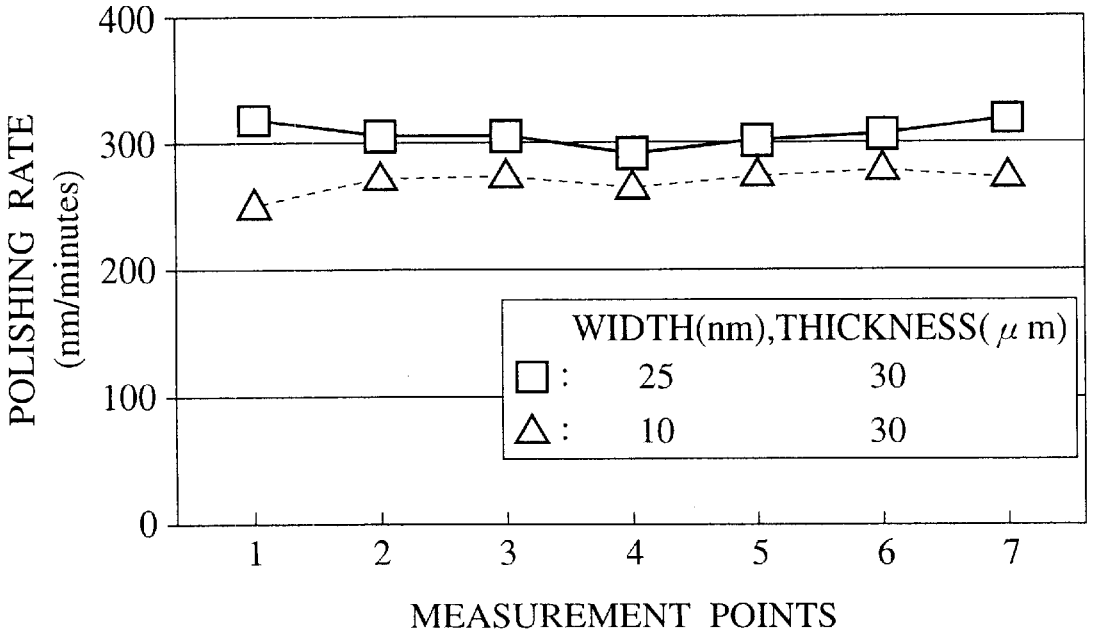
FIG. 15B is a graph showing polishing rates measured at different measurement points on the wafer of FIG. 15A polished with the polishing apparatus of the present invention.

FIG. 15B is a graph showing polishing rates at various measurement it points on a wafer having patterns polished by the polishing apparatus of the present invention. The measurement points 1 to 7 are the same as those of FIG. 14. Triangular marks represent a case with the ring 3 having 181 mm in inner diameter, 201 mm in outer diameter, 10 mm in width, and 30 $\mu$m in thickness. Square marks represent a case with the ring 3 having 151 mm in inner diameter, 201 mm in outer diameter, 25 mm in width, and 30 $\mu$m in thickness. Other polishing conditions are the same as those used for the wafer having no patterns. The 10-mm-width ring 3 represented with the triangular marks provides polishing rates about 2.5 times larger than those of the wafer having no patterns. Like the case of FIG. 14, polishing rates at the measurement points 1 and 7 are smaller than those at the measurement points 2, 3, 5, and 6. This tendency is also observed in FIG. 4 and is common when the guide 5 is pressed against the polishing cloth 7 when polishing a wafer. The 25-mm-width ring 3 represented with the square marks provides polishing rates about 3 times larger than those of the wafer having no patterns. Polishing rates at the measurement points 1 and 7 am larger than those at the measurement points 2, 3, 5, and 6. In this way, changing the width of the ring 3 changes polishing rates at the periphery of a wafer relative to polishing rates at the other part of the wafer.

Second Embodiment

The second embodiment polishes a polysilicon film formed on an 8-inch silicon wafer.

The second embodiment employs the polishing apparatus of FIG. 8A with different rings. A first ring 3 has an inner diameter of 181 mm, an outer diameter of 201 mm, and a thickness of 50 $\mu$m. A second ring 3 has an inner diameter of 191 mm, an outer diameter of 201 mm, and a thickness of 30 $\mu$m. The surface plate 8 and polishing cloth 7 are rotated at 100 rpm. The abrasive 12 is supplied onto the polishing cloth 7 at 250 cc/min. The wafer 1 is set on the wafer base 13, which is rotated at 100 rpm and is pressed against the polishing cloth 7 under 300 g/cm$^2$. The air 14 is pressurized to 150 g/cm$^2$ to press a central part of the top of the wafer 1.

Figure 16:
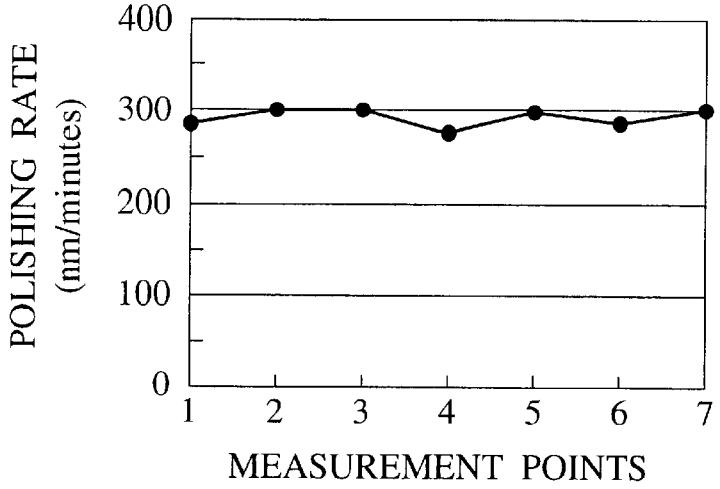
FIGS. 16 to 18 are graphs showing polishing rates measured at different measurement points on polysilicon films of wafers polished with the polishing apparatus of the present invention.
Figure 17:
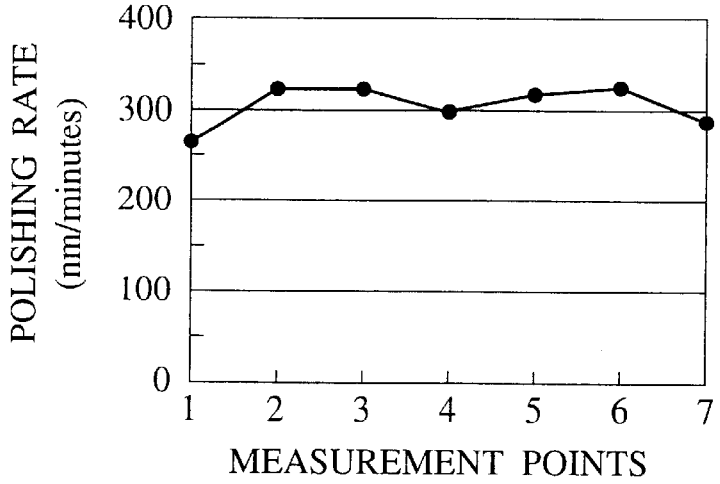
Figure 18:
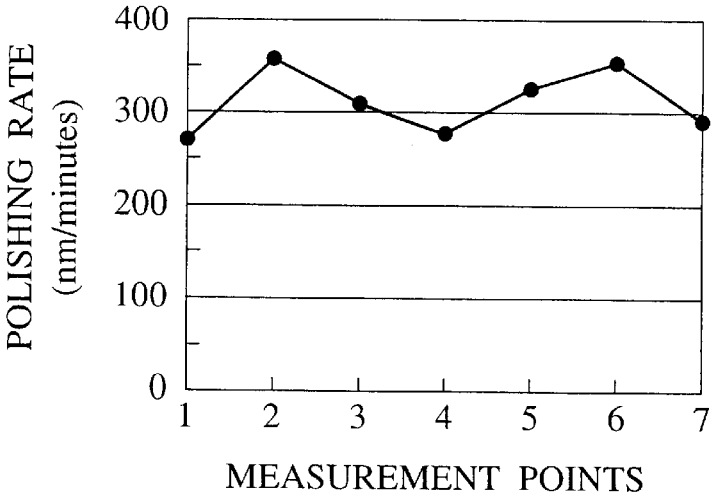

FIG. 16 is a graph showing polishing rates at various measurement points on the polysilicon film formed on the silicon wafer 1 of 200 mm in diameter polished with the first ring 3 and with both the wafer 1 and guide 5 pressed against the polishing cloth 7. FIG. 17 is a graph showing polishing rates with the second ring 3 under the same conditions as those of FIG. 16. FIG. 18 is a graph showing polishing rates without the ring 3 under the same conditions as those of FIG. 16. The measurement points 1 to 7 are the same as those of FIG. 14.

In FIG. 16, polishing rates at the peripheral measurement points 1 and 7 are substantially equal to polishing rates at the other measurement points, and a proper uniformity of polishing rates is observed. In FIG. 17, polishing rates at the peripheral measurement points 1 and 7 are relatively lower than polishing rates at in the other measurement points but they are not so low as those of FIG. 18. It is understood tat the first ring provides an effect of sufficiently equalizing polishing rates over the surface of a wafer and that the second ring provides a similar effect. In FIG. 16, the polishing rates at the periphery of the wafer are substantially the same as those at the other parts thereof, and therefore, LSIs formed at the periphery of the wafer will keep criteria.

Third Embodiment

The third embodiment polishes a tungsten (W) film formed on an 8-inch silicon wafer.

The third embodiment employs the polishing apparatus of FIG. 8A with different rings. A first ring 3 has an inner diameter of 181 mm, an outer diameter of 201 mm, a width of 10 mm, and a thickness of 30 $\mu$m. A second ring 3 has an inner diameter of 151 mm, an outer diameter of 201 mm, a width of 25 mm, arid a thickness of 30 $\mu$m. A third ring 3 has an inner diameter of 151 mm, an outer diameter of 201 mm, a width of 25 mm, and a thickness of 35 $\mu$m. A fourth ring 3 has an inner diameter of 191 mm, an outer diameter of 201 mm, a width of 5 mm, and a thickness of 60 $\mu$m. The surface plate 8 and polishing cloth 7 are rotated at 100 rpm, The abrasive 12 is supplied onto the polishing cloth 7 at 200 cc/min. The wafer 1 is set on the wafer base 13, which is rotated at 50 rpm and is pressed against the polishing cloth 7 under 200 g/cm$^2$. The air 14 is pressurized to 130 g/cm$^2$ to press a central part of the top of the wafer 1.

Figure 19:
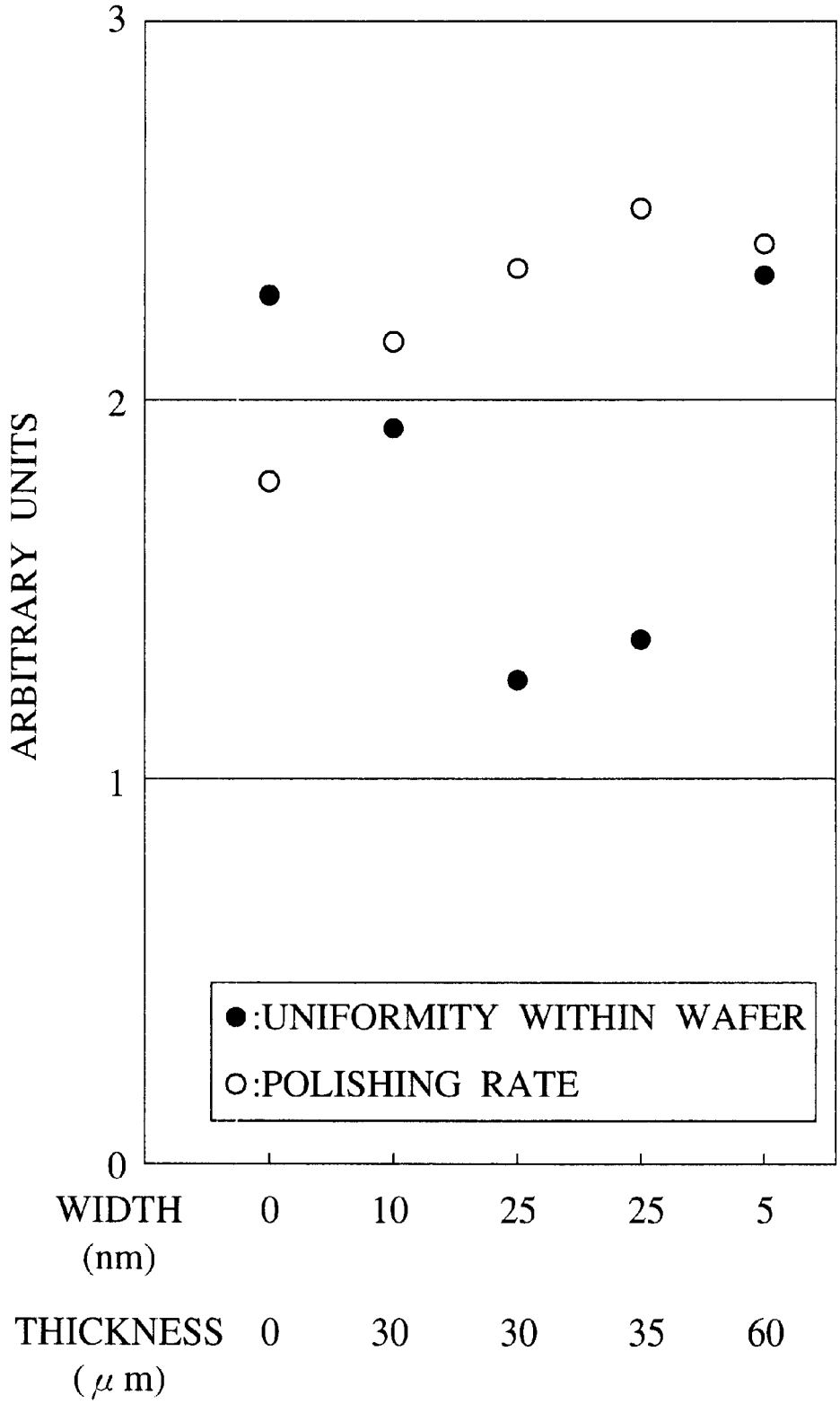
FIG. 19 is a graph showing relationships among the shapes of rings, polishing rates on a tungsten film of a wafer, and the uniformity of the polishing rates on the tungsten film of the wafer polished with the polishing apparatus of the present invention.

FIG. 19 is a graph showing relationships between the uniformity of polishing rates on silicon wafers each of 200 mm in diameter and the polishing rates when polishing tungsten films formed on the wafers with the four types of rings. An abscissa of the graph indicates a case with no ring (0 mm wide, 0 $\mu$m thick), a case with the first ring (10 mm wide, 30 $\mu$m thick), a case wit the second ring (25 mm wide, 30 $\mu$m thick), a case with the third ring (25 mm wide, 35 $\mu$m thick), and a case with the fourth ring (5 mm wide, 60 $\mu$m thick). Each white dot in the graph indicates a polishing rate and a black dot a uniformity of polishing rates on a wafer. Compared with the case using no ring, the first ring improves the polishing rate uniformity and increases polishing rates, the second and third rings fiber improve the poling rate uniformity and increase polishing rates, and the fourth ring shows no change in the polishing rate uniformity and increases polishing rates to the levels of the second and third rings. Consequently, it is understood that the second and third rings sufficiently improve polishing rates and the uniformity thereof and that the first ring provides a proper effect. The rings improve not only the uniformity of polishing rates but also polishing rates themselves. Accordingly, the rings are capable of maintaining the quality of LSIs formed at the periphery of a wafer within criteria and shortening a polishing time to improve productivity and reduce production cost. The fourth ring provides an effect of improving polishing rates.

Although the present invention has been explained based on the embodiments, the present invention is not limited to these embodiments and accompanying drawings. It is apparent for persons skilled in the art that many modifications, alterations, and applications are possible based on the disclosure of the present invention.

For example, the present invention is applicable to polishing 6-inch wafers, 12-inch wafers, VLSIs, etc. Semiconductor materials to which the present invention is applicable include not only silicon but also compound semiconductor such as gallium arsenide (GaAs).

In the above explanation, the guide 5 is pressed against the polishing cloth 7. The present invention is applicable when the guide 5 is away from the polishing clod 7. In this case, the backing structure is curved into a convex toward an object, e.g., a wafer.

Various modifications will become possible for those skilled in the art after receiving the teachings of the present disclosure without departing from the scope thereof.

What is claimed is:

1. A backing plate for polishing an object comprising:

a flat disk having top and bottom faces that are in parallel with each other; and a cylindrical ring having top and bottom faces that are in parallel with each other and are defined by concentric outer and inner circles, a diameter of the outer circle being equal to a diameter of the disk, a center of the top face of the ring agreeing with a center of the bottom face of the disk, and a diameter of the inner circle being smaller than a diameter of the object.

2. The backing plate of claim 1, wherein:

a height of said ring is in the range of 30 $\mu$m to 60 $\mu$m; and difference between the diameters of the outer and inner circles of said ring is within the range of 10 mm to 60 mm.

* * * * *